US006182296B1

(12) United States Patent
Hosogai

(10) Patent No.: US 6,182,296 B1
(45) Date of Patent: Feb. 6, 2001

(54) REVERSIBLE DENIM JACKET AND PANTS

(76) Inventor: Toshio Hosogai, One Irving Pl. V29b, New York, NY (US) 10003

( * ) Notice: Under 35 U.S.C. 154(b), the term of this patent shall be extended for 0 days.

(21) Appl. No.: 09/309,655

(22) Filed: May 10, 1999

(51) Int. Cl.[7] ..... A41D 1/06; A41D 1/02

(52) U.S. Cl. ..... 2/227; 2/108; 2/85; 2/93; 2/DIG. 2

(58) Field of Search ..... 2/DIG. 2, 108, 2/85, 93, 227

(56) References Cited

U.S. PATENT DOCUMENTS

| | | | | |
|---|---|---|---|---|
| 1,914,239 | * | 6/1933 | Berkwits | 2/DIG. 2 |
| 2,890,460 | * | 6/1959 | Levi | 2/DIG. 2 |
| 3,234,564 | * | 2/1966 | Chujfi | 2/DIG. 2 |
| 4,106,120 | | 8/1978 | Zurbrigg | 2/DIG. 2 |
| 4,310,929 | | 1/1982 | Finlay | 2/DIG. 2 |
| 4,472,835 | | 9/1984 | Clark | 2/DIG. 2 |
| 4,481,683 | | 11/1984 | Estruch | 2/418 |
| 4,686,714 | | 8/1987 | Harley | 2/74 |
| 5,029,344 | | 7/1991 | Shannon | 2/115 |
| 5,063,614 | | 11/1991 | McSheffery | 2/102 |
| 5,204,995 | | 4/1993 | Knapp | 2/227 |
| 5,561,860 | | 10/1996 | Nguyen | 2/115 |
| 5,720,044 | | 2/1998 | Robinson | 2/115 |

* cited by examiner

*Primary Examiner*—Bibhu Mohanty
(74) *Attorney, Agent, or Firm*—John D. Gugliotta

(57) ABSTRACT

Reversible denim jacket and pants are disclosed, comprised of a pant and jacket combination, made from denim, and designed to be reversible and fashionable. Unique stitching and fastening means adds to the functionality and usability of the present invention.

13 Claims, 11 Drawing Sheets

REVERSIBLE DENIM JACKET AND PANTS

BACKGROUND OF THE INVENTION

1. Field of Invention

This invention relates to an approach for producing reversible clothing, including pants and jackets, and more particularly such a method and its resultant particular style of denim pants and jackets.

2. Description of Prior Art

Reversible clothing is known in the art. Reversible garments are designed such that the two surfaces of the garment have a different pattern, color, or texture. Therefore, the user is provided with two choices of pattern, color or fabric texture with each garment.

Some types of reversible garments are constructed using two different types of fabrics. The two fabrics are sewn together such that a different fabric faces out when the garment is turned inside out and vice versa. The problem with this design is that the clothing is typically bulky and uncomfortable due to the two layer thickness of the garment fabric. In order to solve this problem, reversible garments were designed using two-sided, single thickness fabric. Because the fabric is only one layer in thickness, the garment is relatively thin and comfortable to wear, yet the garment is reversible.

Reversible pants could also be used when one side of the pants has been permanently stained, but the reversible side has not been effected. Thus, the stain does not precipitate disposal of the pants.

Reversible pants are traditionally designed using two different types of fabrics, sewn together so that a different fabric faces outward. However, this dual-fabric configuration can often be bulky and uncomfortable to wear. To solve this problem, the two fabrics may be made thinner. However, this creates the problem of reduces strength of each fabric, which increases the likelihood of tearing of either fabric.

Use of a single, thicker fabric reduces the bulk created by the dual fabric configurations, while simultaneously increases structural integrity of the pants.

Another problem commonly found in reversible pants concerns pocket and fastening means.

Any pockets used in the pants must be easily accessible when either side of the fabric is outward facing. Placing two pockets, one on either side, increases bulkiness, especially in dual fabric configurations. Further, buttons or zippers accessible from one side of the garment must be just as easily accessible when the pants are reversed. Also, pocket attachment must be achieved to reduces bunching of the pockets when not in use.

In the related art, several devices are disclosed that describe a reversible shirt/sweater with extended sleeves. These include U.S. Pat. No. 5,720,044, issued in the name of Robinson and U.S. Pat. No. 5,561,860, issued in the name of Nguyen-Senderowicz.

U.S. Pat. No. 5,204,995 issued in the name of Knapp, discloses reversible pants.

U.S. Pat. No. 4,310,929, issued in the name of Finlay, describes reversible running shorts.

U.S. Pat. No. 4,481,683, issued in the name of Estruch, discloses reversible, uni-sex underwear.

U.S. Pat. No. 5,063,614, issued in the name of McSheffery, discloses a reversible, upper body garment having detachable pockets.

Several patents describe a reversible thermal vest garment. These include U.S. Pat. No. 5,029,344, issued in the name of Shannon et al., U.S. Pat. No. 4,472,835, issued in the name of Clark and U.S. Pat. No. 262,577, issued in the name of Day.

U.S. Pat. No. 4,686,714, issued in the name of Harley, discloses a reversible dress.

U.S. Pat. No. 4,106,120 issued in the name of Zurbrigg et al. discloses a reversible surgical gown.

A search of the prior art did not disclose any patents that anticipate directly many features of the instant invention. Consequently, a need has been felt for providing improved reversible pants that overcome the problems cited above.

SUMMARY OF THE INVENTION

It is therefore an object of the present invention to provide a common approach and method for producing reversible denim clothing.

It is a further object of the present invention to provide an approach and method for producing reversible denim clothing including pants and jackets resulting in a particular identifiable style of denim pants and jackets.

Briefly described according to the preferred embodiment of the present invention, a reversible pair of pants is disclosed utilizing an otherwise conventional denim fabric. The pants include a pair of one-part pocket pouches sewn directly onto the front pantleg members, and another pair of similar one-part pocket pouches sewn directly onto the rear pantleg members, thereby forming symmetric front and rear pouch pockets. Further, a jacket is provided in concert utilizing an otherwise conventional denim fabric. The jacket includes a similar pair of one-part pocket pouches sewn directly onto the front chest panel members, thereby forming symmetric left and right pouch pockets. On the inside of both the pants and jacket each seam utilizes a four-part rolled construction that provides a clean, finished look to the interior portions of the garments. Finally, on the interior surface of each respective garment element a one-part pocket pouch is sewn directly onto the interior surface, directly opposite the exterior pocket pouch. This is provided both for the pant and jacket components. For the pant component, a fly opening comprising a first panel and a second panel, wherein the first panel and second panel define a plurality of buttonholes, the buttonholes on the first panel being aligned with the buttonholes on the second panel, a plurality of double stud buttons, each of the buttons including a first and a second stud portion interconnected by a narrow neck portion, the buttons passing through the button holes so as to secure the first panel to the second panel when the garment is being worn, and further wherein one stud portion of each of the double stud buttons is visible when the pants are worn with either the first surface or the second surface facing out, and the first and second stud portions of each button being of a size to pass through an adjacent buttonhole; whereby with either orientation of the reversible pants, the fly may be buttoned and unbuttoned in a normal manner with the outer stud portion of each button passing through a corresponding outer buttonhole.

Similarly, for the jacket component, an opening comprising a first panel and a second panel, wherein the first panel and second panel define a plurality of buttonholes, the buttonholes on the first panel being aligned with the buttonholes on the second panel, a plurality of double stud buttons, each of the buttons including a first and a second stud portion interconnected by a narrow neck portion, the buttons passing through the button holes so as to secure the first panel to the second panel when the garment is being worn, and further wherein one stud portion of each of the double stud buttons is visible when the pants are worn with either the first surface or the second surface facing out, and the first and second stud portions of each button being of a size to pass through an adjacent buttonhole; whereby with either orientation of the reversible pants, the fly may be buttoned and unbuttoned in a normal manner with the outer stud portion of each button passing through a corresponding outer buttonhole.

The pants of the present invention provide reversible fashion that emulates the appearance of a "mirror image." Similarly, the jacket of the present invention provide a similar "mirror image" appearance in conjunction with the pant component.

| Descriptive Key |
|---|
| 10 reversible denim jacket and pants |
| 14 outer pants surface |
| 16 inner pants surface |
| 18 front exterior pocket pouch |
| 20 rear exterior pocket pouch |
| 22 front interior pocket pouch |
| 24 rear interior pocket pouch |
| 50 jacket |
| 52 exterior jacket pocket pouch |
| 54 front chest panel members |
| 60 interior jacket pocket pouches |
| 70 first panel |
| 80 second panel |
| 90 button hole |
| 100 button |
| 110 first stud portion |
| 120 second stud portion |
| 130 neck portion |
| 140 jacket first panel |
| 150 jacket second panel |
| 160 jacket button hole |
| 170 jacket adjustment means |
| 180 collar |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE DRAWINGS

Figure 1:
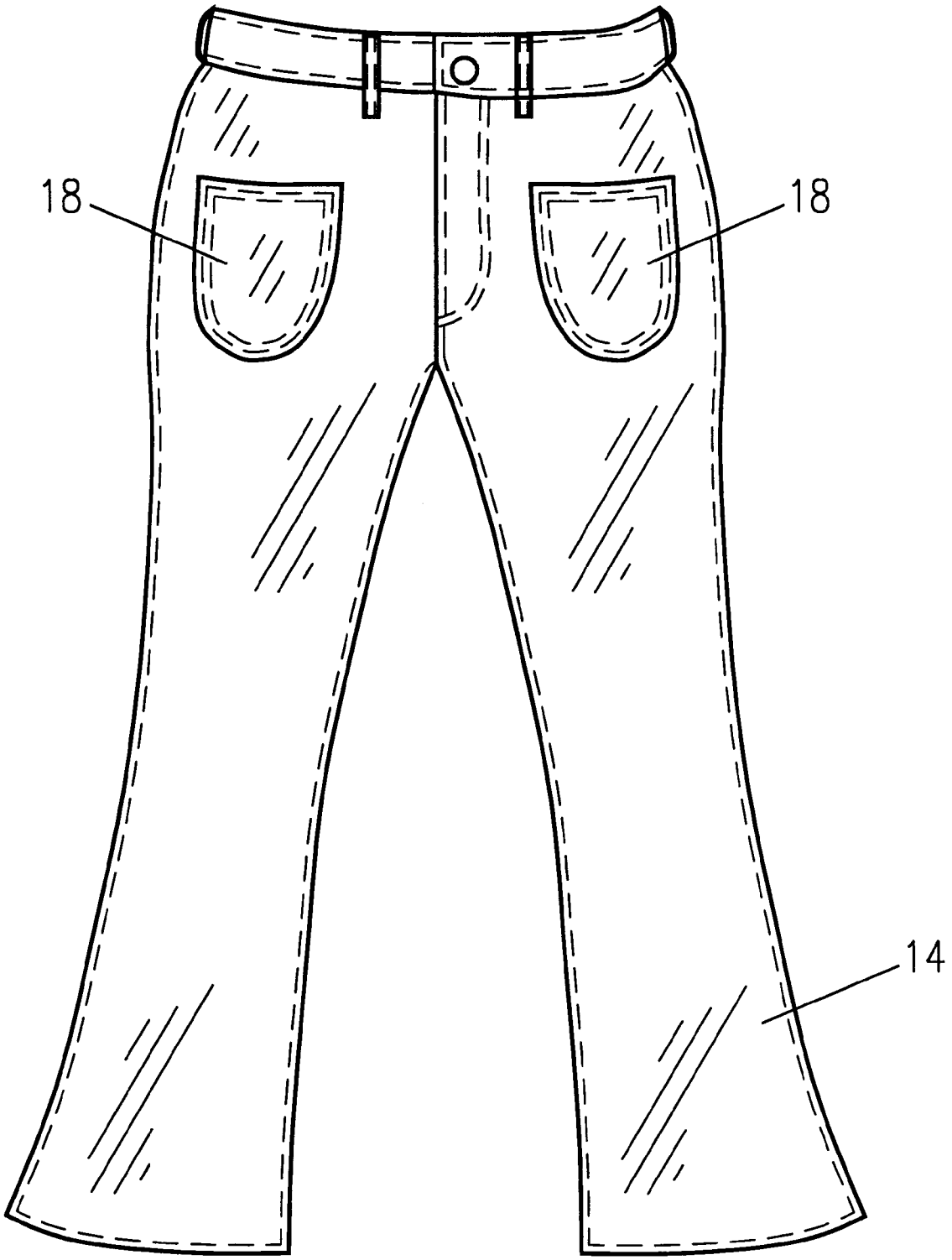
FIG. 1 is a front view of a pair of reversible pants illustrating the principles of the present invention.
Figure 2:
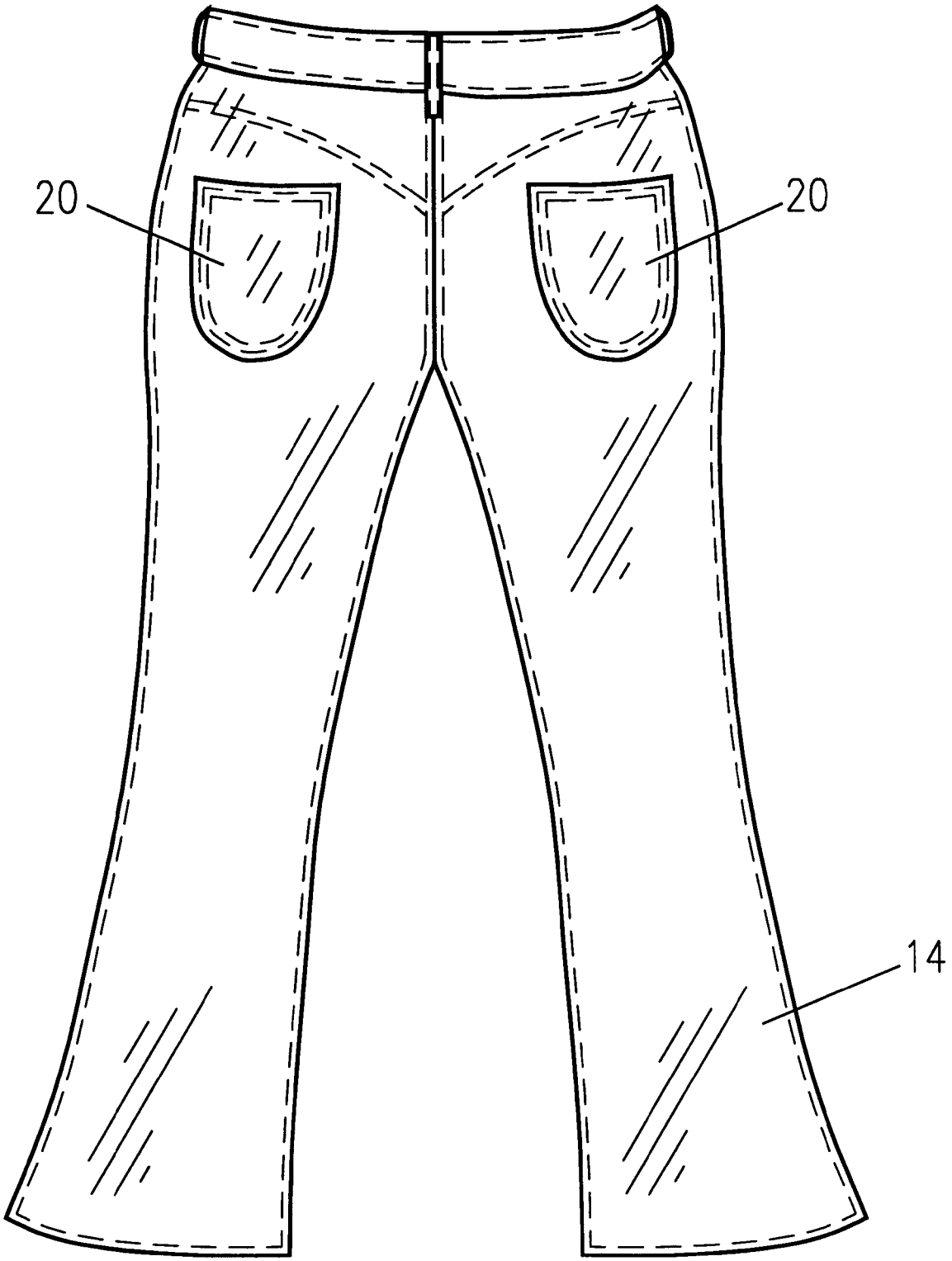
FIG. 2 is a rear view thereof.

Referring now to FIGS. 1–4, a reversible pair of pants 10 is shown. The reversible pants 10 include an outer pants surface 14 and an inner pants surface 16 made of a plurality of conventional pant panel elements. The best mode, represented by the commercial embodiment of the present invention incorporates otherwise conventional denim fabric to form the pant panel elements. Therefore, the outer pants surface 14 and inner pants surface 16 have different appearances in color, pattern, and texture.

The pants include a pair of front, exterior pocket pouches 18 sewn directly onto the front pantleg members, and a pair of similar rear exterior pocket pouches 20 sewn directly onto the rear pantleg members, thereby forming symmetric front and rear exterior pouch pockets. On the front, interior surface of the pants 10 is a pair of front interior pocket pouch 22 sewn directly onto the front interior surface of the pants, directly opposite the front exterior pocket pouches 18.

On the back interior surface of the pants is a pair of rear interior pocket pouches 24, sewn directly onto the rear interior surface of the pants, directly opposite the rear exterior pocket pouches 20.

It is envisioned that the front interior pocket pouches 22 are slightly smaller than the front exterior pocket pouches 18 so that the stitching on the edges of the front exterior pocket pouches 18 is visible around the edge of the front interior pocket pouches 22. The same is true for the rear exterior pocket pouches 20 and the smaller rear interior pocket pouches 24.

Referring now to FIGS. 5–12, a jacket 50 is provided in concert utilizing an otherwise conventional denim fabric. The jacket 50 includes a pair of exterior jacket pocket pouches 52, similar to the front exterior pocket pouches 18 on the pants. The exterior jacket pocket pouches 52 are sewn directly onto the front chest panel members 54 of the jacket 50, thereby forming symmetric left and right exterior jacket pocket pouches 52.

Figure 7:
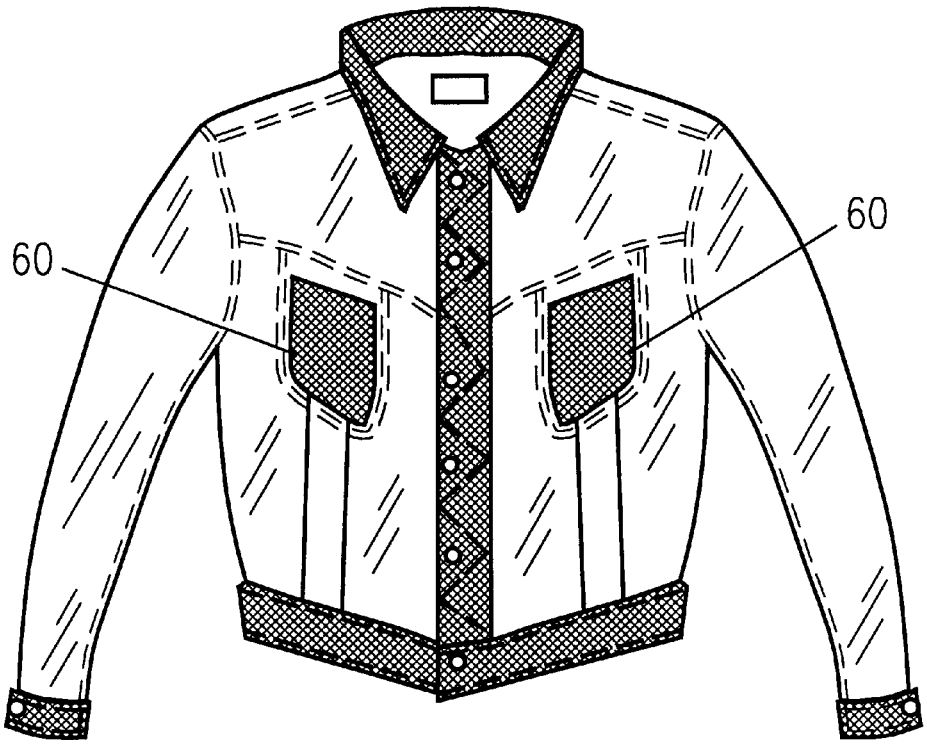
FIG. 7 is a front view thereof shown with the inside surface of FIG. 5 depicted as the outside surface.
Figure 8:
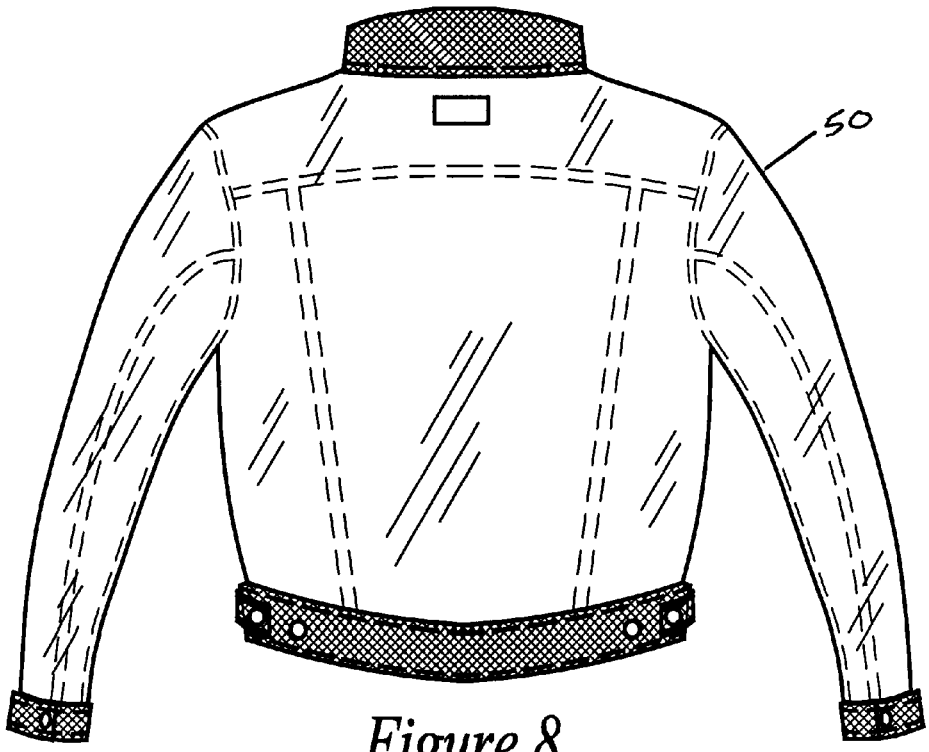
FIG. 8 is a rear view of the configuration shown in FIG. 7.
Figure 9:
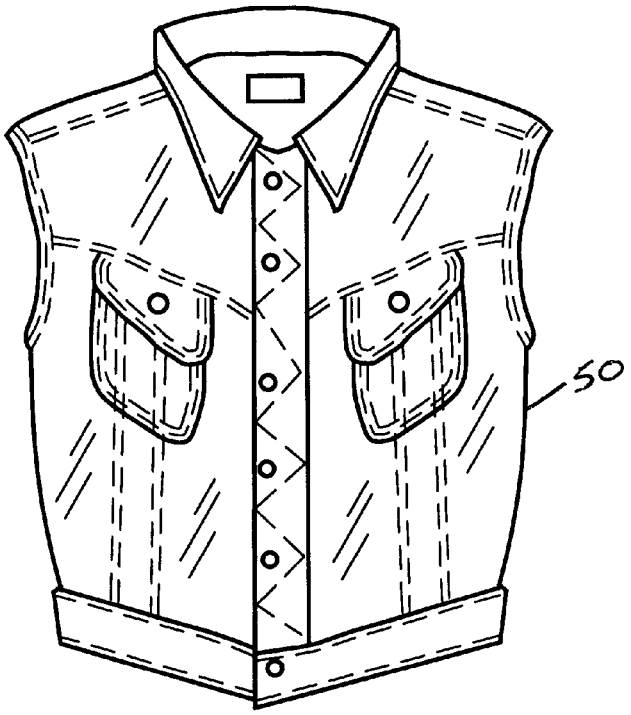
FIG. 9 is a front view of an alternate embodiment for a sleeveless reversible jacket illustrating the principles of the present invention.
Figure 10:
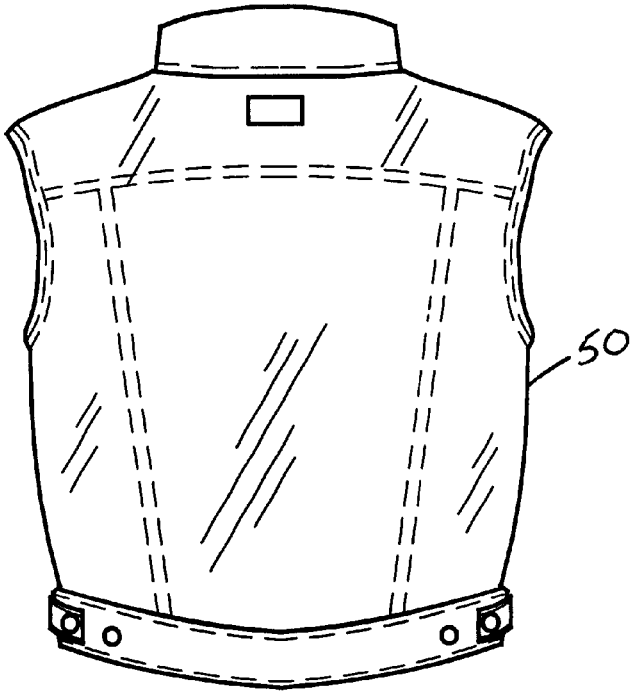
FIG. 10 is a rear view thereof.
Figure 11:
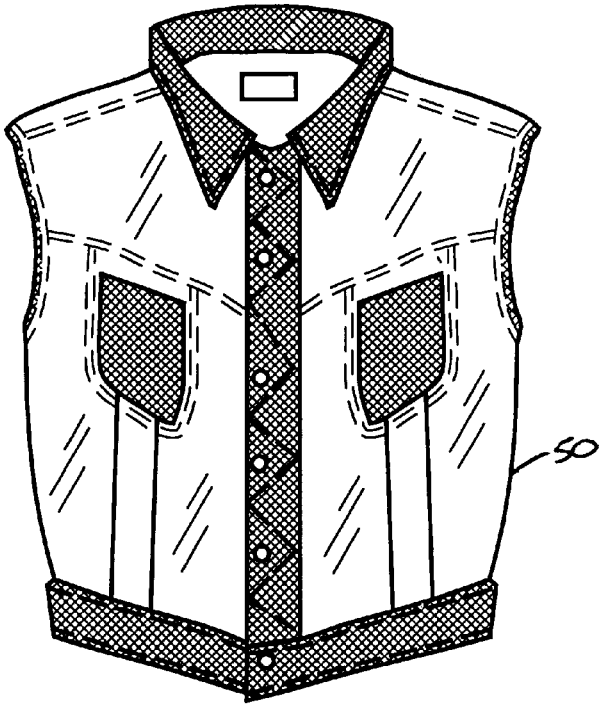
FIG. 11 is a front view thereof shown with the inside surface of FIG. 9 depicted as the outside surface.
Figure 12:
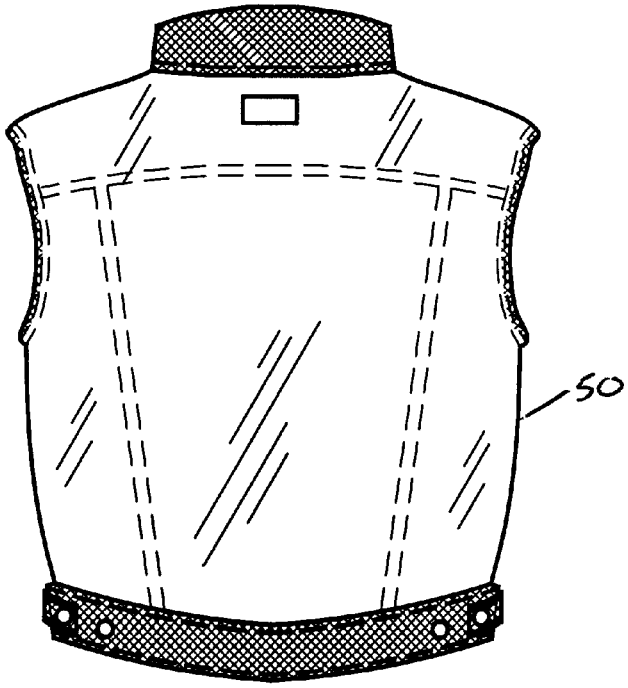
FIG. 12 is a rear view of the configuration shown in FIG. 11.

Referring now to FIG. 7, on the front interior surface of the jacket 50 is a pair of interior jacket pocket pouches 60, similar in configuration to the front interior pocket pouches 22 found on the front interior of the pants. The pair of interior jacket pocket pouches 60 are sewn directly onto the interior surface of the front of the jacket 50, directly opposite the exterior jacket pocket pouches 52.

The pants of the present invention provide reversible fashion that emulates the appearance of a "mirror image." Similarly, the jacket of the present invention provide a similar "mirror image" appearance in conjunction with the pant component.

Figure 3:
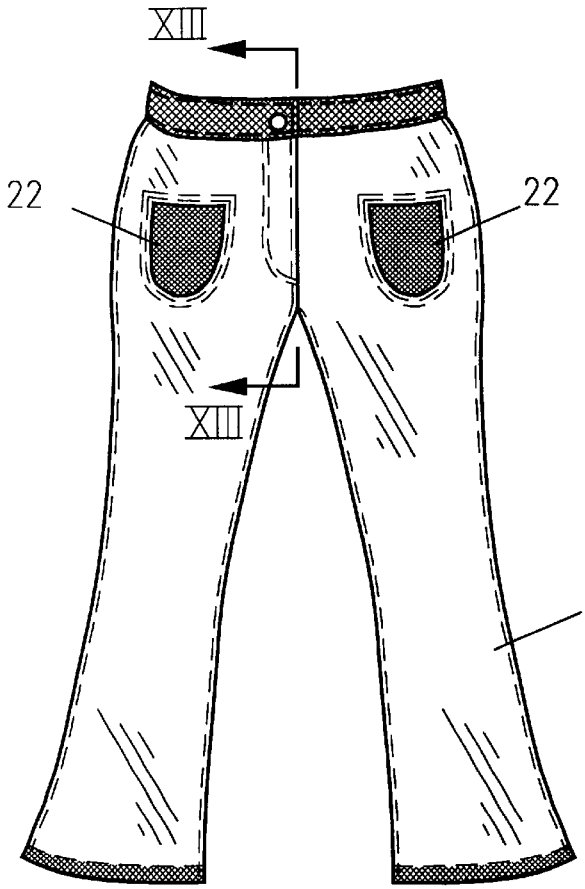
FIG. 3 is a front view thereof shown with the inside surface of FIG. 1 depicted as the outside surface.
Figure 4:
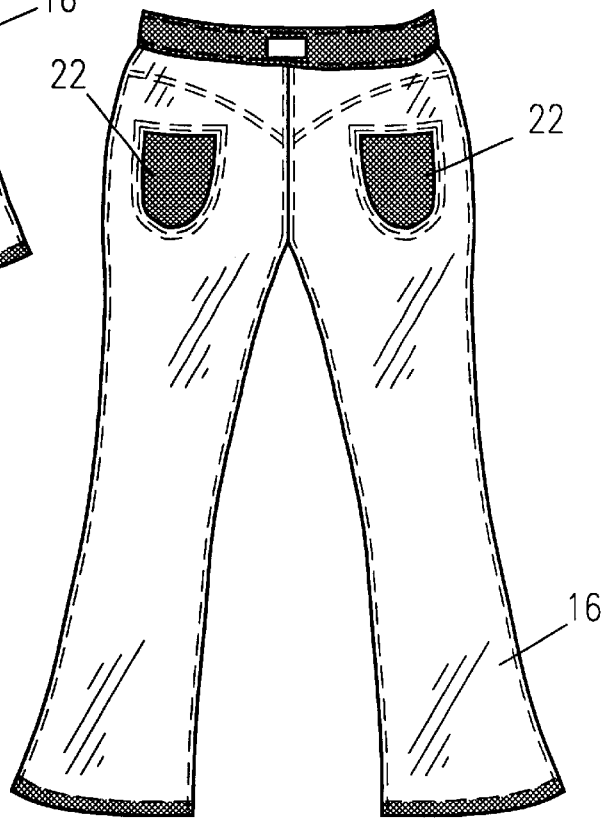
FIG. 4 is a rear view of the configuration shown in FIG. 3.
Figure 5:
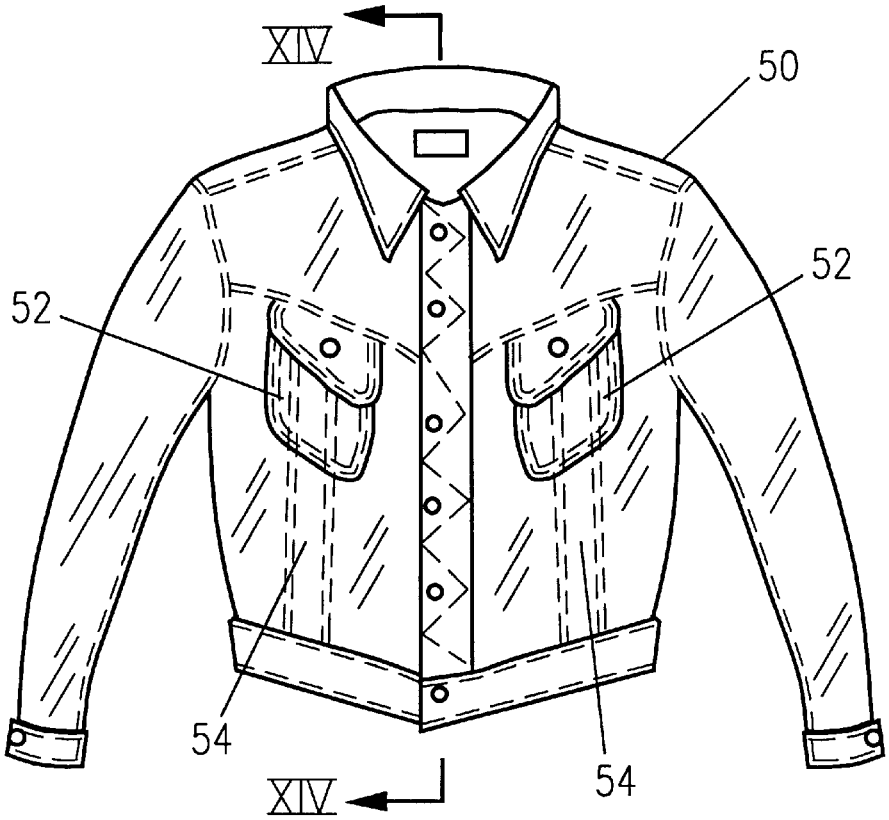
FIG. 5 is a front view of a reversible jacket illustrating the principles of the present invention.
Figure 6:
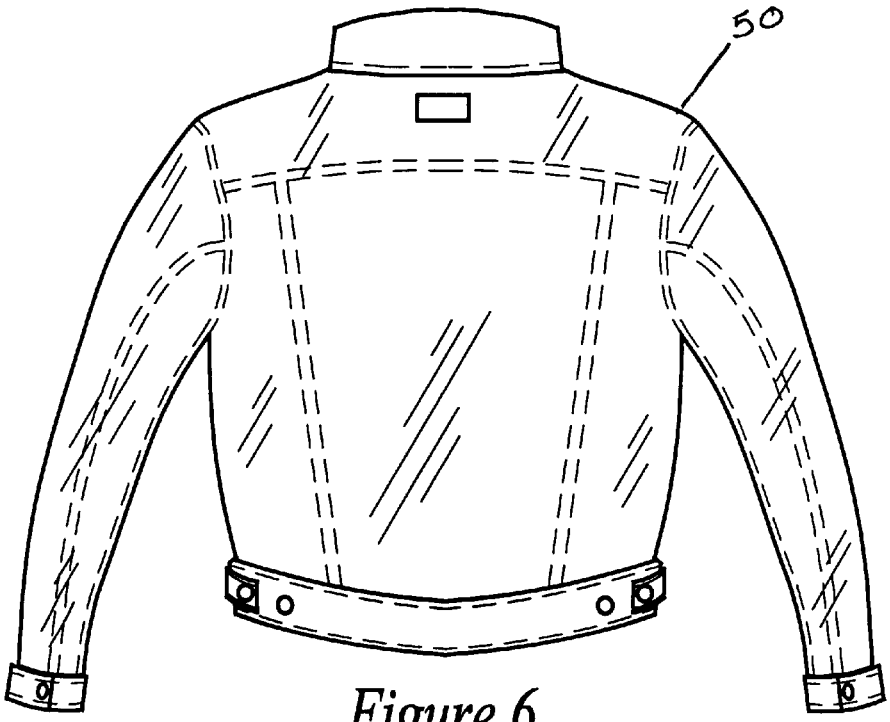
FIG. 6 is a rear view thereof.
Figure 13:
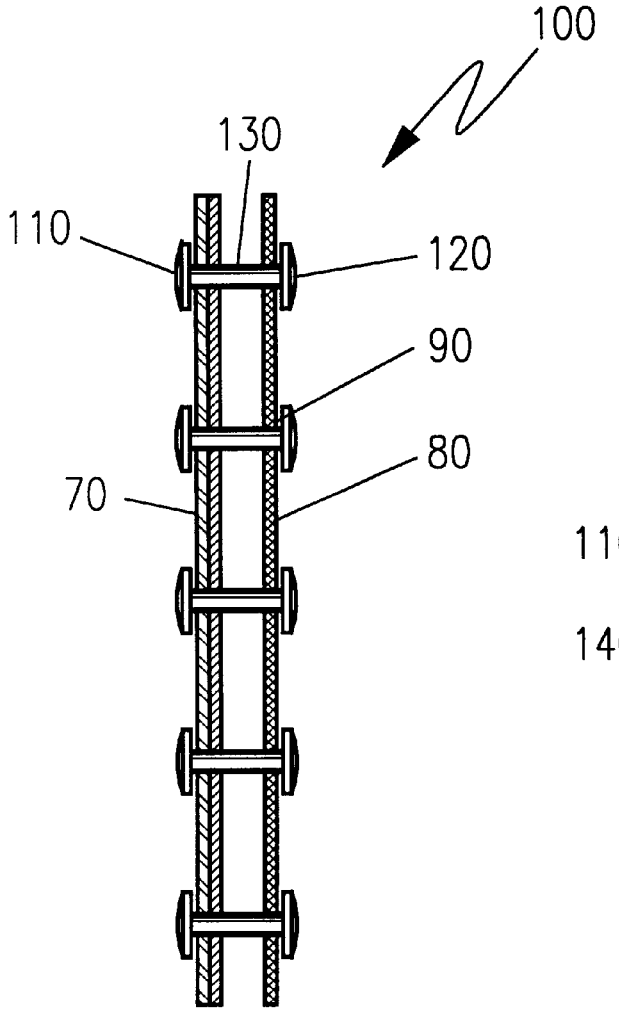
FIG. 13 is a cross-sectional view of the reversible fly with a double stud button inserted through the aligned buttonholes, cut along line XIII—XIII of FIG. 3.
Figure 14:
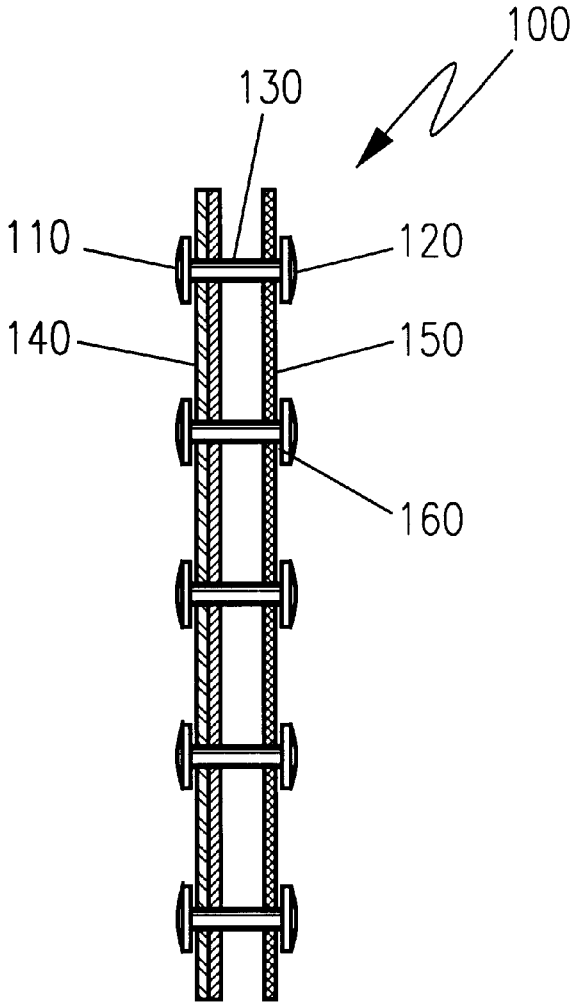
FIG. 14 is a cross-sectional view of the reversible fly with a doble stud button inserted through the aligned buttonholes, cut along lines XIV—XIV of FIG. 5.

As shown in FIGS. 3 and 13, for the pant component, a fly opening comprising a first panel 70 and a second panel 80, wherein the first panel 70 and second panel 80 define a plurality of buttonholes 90, the buttonholes 90 on the first panel being aligned with the buttonholes 90 on the second panel 80, a plurality of double stud buttons 100, each of the buttons 100 including a first stud portion 110 and a second stud portion 120 interconnected by a narrow neck portion 130, the buttons 100 passing through the button holes 90 so as to secure the first panel 70 to the second panel 80 when the garment is being worn, and further wherein one stud portion of each of the double stud buttons 100 is visible when the pants are worn with either the first panel 70 or the second panel 80 facing out, and the first and second stud portions 110,120 of each button 100 being of a size to pass through an adjacent buttonhole 90; whereby with either orientation of the reversible pants, the fly may be buttoned and unbuttoned in a normal manner with the outer stud portion 110,120 of each button passing through a corresponding outer buttonhole 90.

Similarly, for the jacket 50 component, an opening comprising a jacket first panel 140 and a jacket second panel 150, wherein the jacket first panel 140 and second panel define a plurality of jacket buttonholes 160, the jacket buttonholes on the jacket first panel 140 being aligned with the jacket buttonholes 160 on the jacket second panel 150, a plurality of double stud buttons 100, each of the buttons 100 including a first and a second stud portion 110,120 interconnected by a narrow neck portion 130, the buttons 100 passing through the jacket button holes 160 so as to secure the jacket first panel 140 to the jacket second panel 150 when the garment is being worn, and further wherein one stud portion 110,120 of each of the double stud buttons 100 is visible when the jacket 50 is worn with either the exterior surface or the interior surface facing out, and the first and second stud portions 110,120 of each button 100 being of a size to pass through an adjacent jacket buttonhole 160, whereby with either orientation of the reversible jacket 50, the fly may be buttoned and unbuttoned in a normal manner with the outer stud portion 110,120 of each button 100 passing through a corresponding outer jacket buttonhole 160.

It is envisioned that on the pants, a third panel may be sewn to either the first panel 70 or the second panel 80 so as to be in between the first panel 70 and second panel 80 when they are connected together. The button 100 will pass through a button hole in the third panel, but the studs 110,120 will not pass through the button hole. This configuration ensures that the buttons 100 do not separate from both the first panel 70 and the second panel 80 during use.

It is envisioned that on the jacket 50, a jacket third panel may be sewn to one of the jacket panels so as to be in between the jacket first panel 140 and jacket second panel 150 when they are connected together. The button 100 will pass through a jacket button hole in the jacket third panel, but the studs 110,120 will not pass through the jacket button hole. This configuration ensures that the buttons 100 do not separate from both the jacket first panel 140 and the jacket second panel 150 during use.

Figure 15:
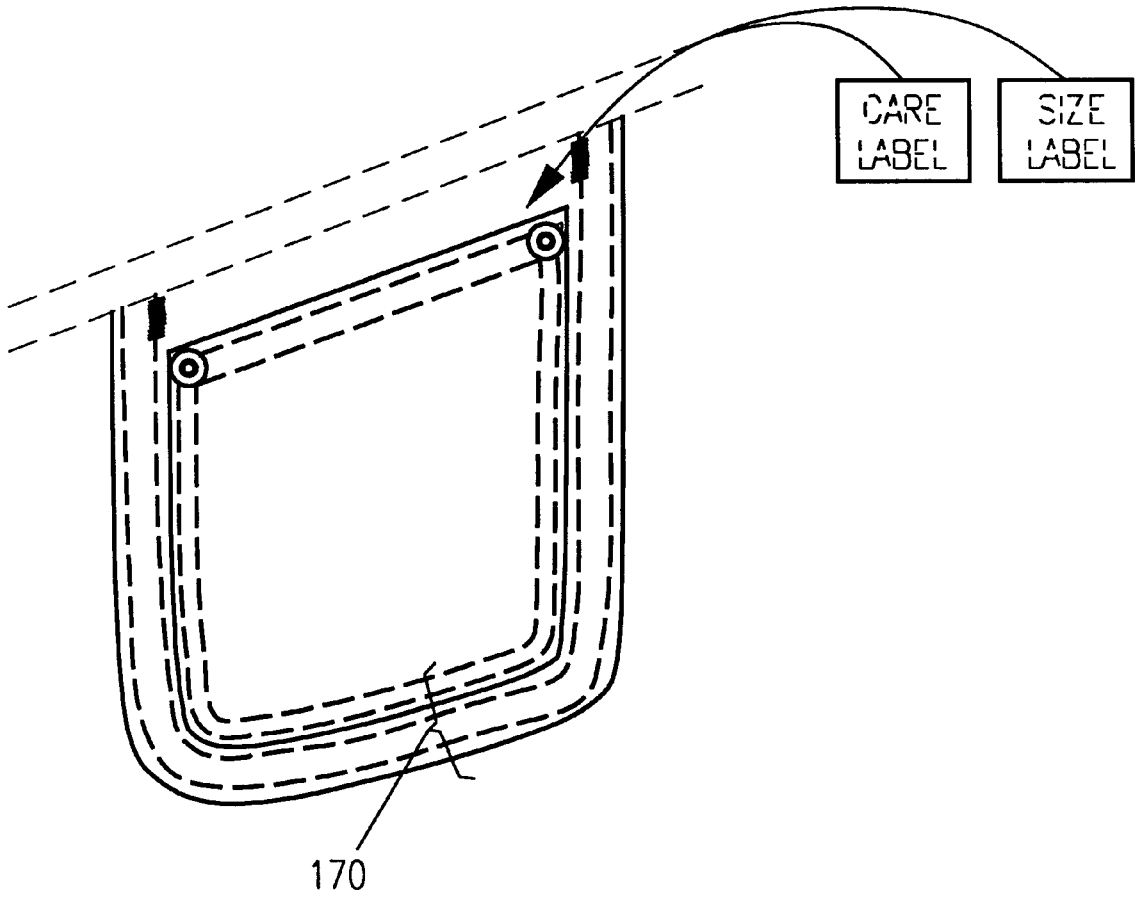
FIG. 15 is a cross sectional view of a typical seam utilizes a four-part rolled construction that provides a clean, finished look to the interior portions of the present invention.

As shown in FIG. 15, on the inside of both the pants and jacket 50 each seam utilizes a four-part rolled construction 170 that provides a clean, finished look to the interior portions of the garments. As designed, a device embodying the teachings of the present invention is easily applied.

Figure 16A:
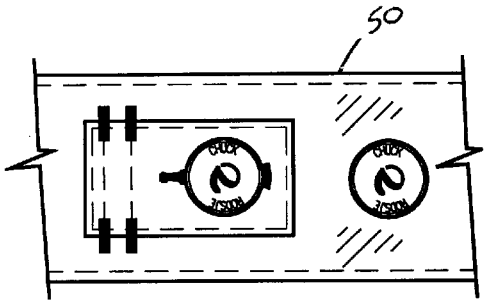
FIGS. 16*a* through 16*d* are partial front views of a waist band element for use with the present invention.
Figure 16B:
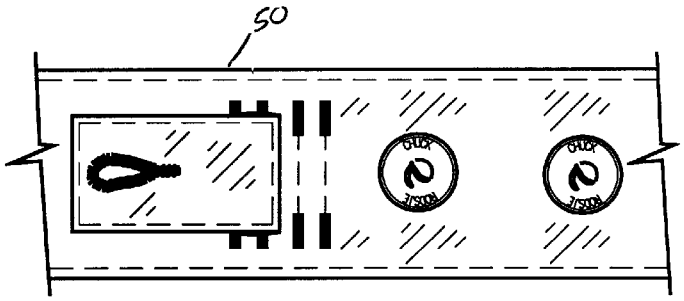
Figure 16C:
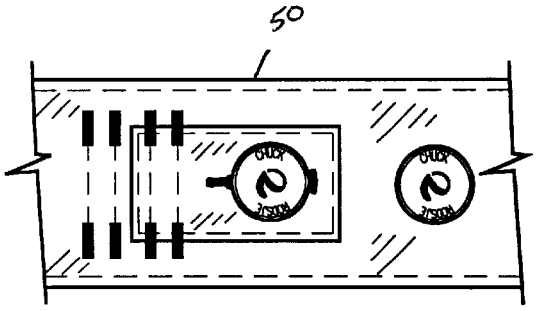
Figure 16D:
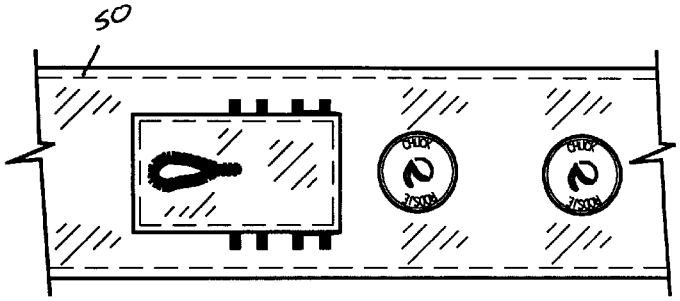

FIGS. 16*a* through 16*b* show the jacket adjustment means 170, used to adjust the size of the bottom of the jacket 50.

Figure 17A:
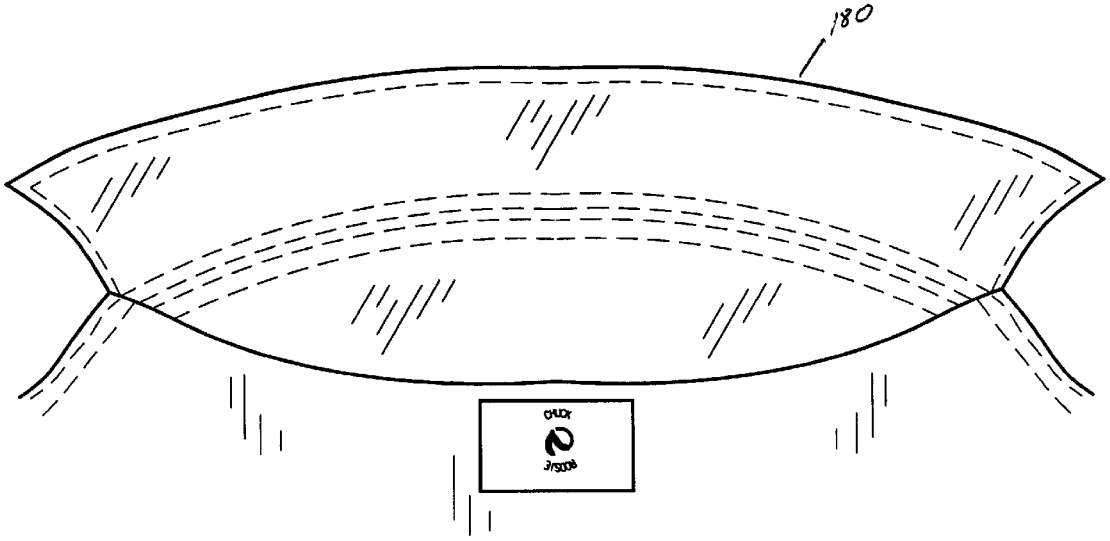
FIGS. 17*a* and 17*b* are partial front views of a reversible collar element for use with the present invention.
Figure 17B:
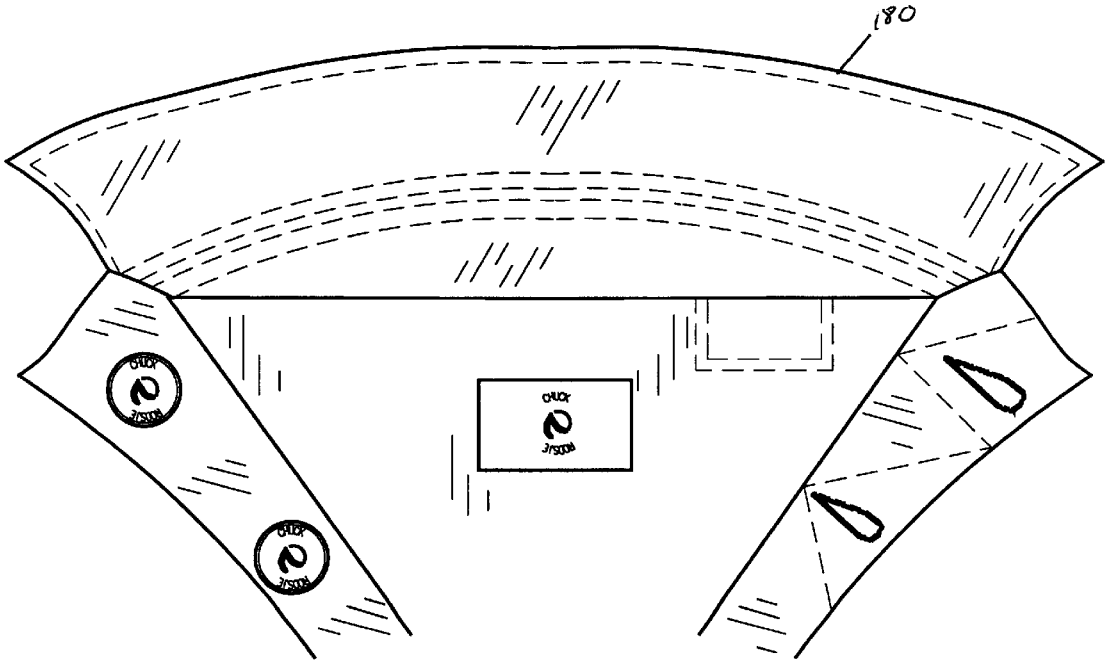

FIGS. 17*a* and 17*b* show the reversible nature of the collar 180 of the jacket 50.

The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. Reversible denim jacket and pants, said reversible denim jacket and pants comprising:

pants, said pants having a front pantleg member and a rear pantleg member, and said pants being constructed of denim and reversible, wherein said pants further comprise a pair of front, exterior pocket pouches, said front, exterior pockets sewn directly onto said front pantleg members; a pair of rear exterior pocket pouches, said rear exterior pocket pouches sewn directly onto said rear pantleg members, thereby forming symmetric front and rear exterior pouch pockets; and a jacket, said jacket having front chest panel members, and said jacket being constructed of denim and being reversible in design;

a pair of front interior pocket pouches, said front interior pocket pouches sewn directly onto the front interior surface of said pants, directly opposite said front exterior pocket pouches wherein said front interior pocket pouches are slightly smaller than said front exterior pocket pouches so that the stitching on the edges of said front exterior pocket pouches is visible around the edge of said front interior pocket pouches; and a pair of rear interior pocket pouches, said rear interior pocket pouches sewn directly onto the rear interior surface of said pants, directly opposite said rear exterior pocket pouches.

2. The reversible denim jacket and pants of claim 1, wherein said rear interior pocket pouches are slightly smaller than said rear exterior pocket pouches so that the stitching on the edges of said rear exterior pocket pouches is visible around the edge of said rear interior pocket pouches.

3. The reversible denim jacket and pants described in claim 1, wherein said jacket further comprise:

a pair of exterior jacket pocket pouches, similar to said front exterior pocket pouches on said pants, said exterior jacket pocket pouches sewn directly onto said front chest panel members of said jacket thereby forming symmetric left and right exterior jacket pocket pouches; and a pair of interior jacket pocket pouches, said interior jacket pocket pouches sewn directly onto the interior surface of the front of said jacket, directly opposite said exterior jacket pocket pouches.

4. The reversible denim jacket and pants of claim 3, wherein said interior jacket pocket pouches are slightly smaller than said exterior jacket pocket pouches so that the stitching on the edges of said exterior jacket pocket pouches is visible around the edge of said interior jacket pocket pouches.

5. The reversible denim jacket and pants described in claim 1, wherein said pants and jacket provide reversible fashion that emulates the appearance of a "mirror image."

6. The reversible denim jacket and pants described in claim 1, wherein said pants further comprise:

a first panel;

a second panel, said first panel and said second panel defining a plurality of buttonholes, said buttonholes on said first panel being aligned with said buttonholes on said second panel; and a plurality of double stud buttons, each of said buttons including a first stud portion and a second stud portion interconnected by a narrow neck portion.

7. The reversible denim jacket and pants of claim 6, wherein said buttons pass through said button holes so as to secure said first panel to said second panel when said pants are being worn.

8. The reversible denim jacket and pants of claim 6, wherein one stud portion of each of said double stud buttons is visible when said pants are worn with either said first surface or said second surface facing out, and said first and second stud portions of each button being of a size to pass through an adjacent buttonhole; whereby with either orientation of said reversible pants, the pants may be buttoned and unbuttoned in a normal manner with the outer stud portion of each button passing through a corresponding outer buttonhole.

9. The reversible denim jacket and pants of claim 6, wherein the inside of said pants is constructed of a seam utilizing a four-part rolled construction that provides a clean, finished look to the interior portions of the pants.

10. The reversible denim jacket and pants described in claim 1, wherein said jacket further comprises:

a jacket first panel;

a jacket second panel, said jacket first panel and said jacket second panel defining a plurality of jacket buttonholes, said jacket buttonholes on said jacket first panel being aligned with said jacket buttonholes on said jacket second panel;

a plurality of double stud buttons, each of said buttons including a first stud portion and a second stud portion interconnected by a narrow neck portion.

11. The reversible denim jacket and pants of claim 10, wherein said buttons pass through said jacket button holes so as to secure said jacket first panel to said jacket second panel when said jacket is being worn.

12. The reversible denim jacket and pants of claim 10, wherein one stud portion of each of said double stud buttons is visible when said jacket is worn with either said jacket first surface or said jacket second surface facing out, and said first and second stud portions of each button being of a size to pass through an adjacent jacket buttonhole, whereby with either orientation of said reversible jacket, said jacket may be buttoned and unbuttoned in a normal manner with said outer stud portion of each button passing through a corresponding outer jacket buttonhole.

13. The reversible denim jacket and pants of claim 10, wherein the inside of said jacket is constructed of a seam utilizing a four-part rolled construction that provides a clean, finished look to the interior portions of the jacket.

* * * * *